US008067072B2

(12) United States Patent
Tan

(10) Patent No.: US 8,067,072 B2
(45) Date of Patent: Nov. 29, 2011

(54) SELF OPENING BAG STACK AND METHOD OF MAKING SAME

(76) Inventor: Daniel Brian Tan, Kenner, LA (US)

( * ) Notice: Subject to any disclaimer, the term of this patent is extended or adjusted under 35 U.S.C. 154(b) by 1898 days.

(21) Appl. No.: 10/644,435

(22) Filed: Aug. 19, 2003

(65) Prior Publication Data

US 2005/0041890 A1 Feb. 24, 2005

(51) Int. Cl.
*B32B 1/02* (2006.01)
*B32B 1/08* (2006.01)

(52) U.S. Cl. ..... 428/35.7; 428/34.1; 428/34.2; 428/34.3; 428/35.9; 428/36.9

(58) Field of Classification Search ..... 428/34.1, 428/34.2, 34.3, 35.7, 35.9, 36.9
See application file for complete search history.

(56) References Cited

U.S. PATENT DOCUMENTS

| | | | | |
|---|---|---|---|---|
| 4,676,378 | A | 6/1987 | Baxley et al. | |
| 4,785,938 | A | 11/1988 | Benoit, Jr. et al. | |
| 4,796,759 | A | 1/1989 | Schisler | |
| 4,811,417 | A | 3/1989 | Prince et al. | |
| 4,877,473 | A | 10/1989 | Snowdon et al. | |
| 4,981,216 | A | 1/1991 | Wilfong, Jr. | |
| 5,074,674 | A | 12/1991 | Kuklies et al. | |
| 5,078,667 | A * | 1/1992 | Williams | 493/195 |
| 5,078,677 | A * | 1/1992 | Gentelia et al. | 604/6.15 |
| 5,188,235 | A | 2/1993 | Pierce et al. | |
| 5,207,328 | A | 5/1993 | Bose et al. | |
| 5,307,935 | A | 5/1994 | Kemanjian | |
| 5,323,909 | A | 6/1994 | Piraneo et al. | |
| 5,363,965 | A | 11/1994 | Nguyen | |
| 5,464,098 | A | 11/1995 | Tseng et al. | |
| 5,469,970 | A | 11/1995 | Li | |
| 5,690,228 | A | 11/1997 | DeMatteis | |
| 5,865,313 | A | 2/1999 | Huang et al. | |
| 6,079,877 | A | 6/2000 | Chew | |
| 6,269,950 | B1 | 8/2001 | Nguyen | |
| 6,435,350 | B1 * | 8/2002 | Huang et al. | 206/554 |
| 6,446,810 | B1 | 9/2002 | Huang et al. | |
| 6,822,051 | B2 * | 11/2004 | Harris | 525/240 |
| 2002/0107342 | A1 * | 8/2002 | Mawson et al. | 526/129 |

OTHER PUBLICATIONS

Freitag, Royce, Cycletime Tips—General vol. 36: High Density Polyethylene, Dec. 31, 1996.

* cited by examiner

*Primary Examiner* — Marc Patterson
(74) *Attorney, Agent, or Firm* — David A. Belasco; Belasco Jacobs & Townsley, LLP

(57) ABSTRACT

A plurality of stacked polyethylene film bags comprising about 40-48 wt. % high density, high molecular weight polyethylene, 12-20 wt. % high density, medium molecular weight polyethylene, 20-30 wt. % linear low density polyethylene, 0-8 wt. % color concentrate, are releasably adhered together in substantial registration. Each of the bags includes front and rear polyethylene film walls and each of the front and rear walls have first and second side edges, a top edge and a bottom edge. The front and rear walls are integrally joined at their first and second side edges and secured together at their bottom edges. An open mouth portion is defined adjacent the top edges of the bag. At least an upper portion of the outer surface of the front and rear walls of each of the bags has been corona treated. T-shirt style bags using the above formulation are also described.

40 Claims, 2 Drawing Sheets

SELF OPENING BAG STACK AND METHOD OF MAKING SAME

FIELD OF INVENTION

The invention pertains to plastic bags typically used for groceries, produce or other merchandise. More particularly, the invention relates to plastic bags for use with dispensing racks that are designed to open as bags are pulled from the dispenser.

BACKGROUND OF THE INVENTION

Plastic bags are commonly used in supermarkets, department stores and similar applications. These bags have advantages in that they are relatively inexpensive to produce, provide substantial carrying capacity and may include easily used handles. In order to make these bags easier to handle and easier to fill, they are usually used in combination with a dispensing rack or hook. Dispensing racks typically include a pair of horizontally oriented arms from which the bags are suspended by means of holes in upper portions of the bags. If the bags can be made to open as they are pulled from the dispensing rack or hook, they become substantially easier to use. Various techniques have been developed for causing plastic bags to open as they are removed from dispensing racks or hooks.

U.S. Pat. No. 4,811,417, issued to Prince et al. is directed to a handled bag with supporting slits in the handle. The bag-pack is mounted on a support rack that has a base and a pair of supporting arms, as well as mounting fingers for holding a tab portion. The plurality of bags comprising the bag-pack are joined together near the top of the handles by means of welds. The welds are formed using a hot pin.

U.S. Pat. No. 4,676,378 issued to Baxley et al., discloses a bag pack comprising a stack of thermoplastic shopping bags that are bound together and mounted on a rack in such a manner that as one is removed from the rack, the next is opened and remains on the rack to receive material therein. The rack that is used in this invention for the bag pack comprises a flat base with a pair of laterally spaced support arms to accommodate fully expanded bags with handles engaged with the support arms. A transverse member extends between the support arms to support a tab receiving hook element for engagement through the tab apertures. When the bag pack is produced, and either prior to or simultaneously with the forming of a cut line through the stacked bag handles, the flaps are bonded together throughout the full stack. This is done by use of a heated pin or rod extended centrally through the flaps to directly heat seal the flaps together.

U.S. Pat. No. 5,363,965, issued to Nguyen utilizes a self-opening thermoplastic bag system. The bags are supported on two horizontal arms that engage holes in the bag handles. The individual bags of the invention are held together in a bag pack via a heated or cold punch formed near the tab. The punches seen in this invention permeate the walls of the bags such that the rear wall of the next bag remains with the pack and is supported by the tab holding the opened bag in place on the rack as the lead bag is removed from the rack.

U.S. Pat. No. 5,207,328, issued to Bose et al is directed to a thermoplastic bag and bag pack. The bag is made of a thermoplastic material such as high molecular weight, high density polyethylene. Each of the handles of the bags comprise multiple layers of material which results from the configuration utilizing folded pleats, thus there are four layers of material for each of the handles. Each of the handles has an aperture extending through the layers of material in the form of an irregular shaped slit. When the slits are cut, the resulting slits in the material are connected at connection zones. This flexible connection permits loose interengagement of the layers of the inner slit material with some of the other layers of both the inner and outer slit materials. Thus, the need for cold welding or hot welding is eliminated and the alignment of the bags depends solely on the interengagement of the slit materials.

U.S. Pat. No. 5,469,970 issued to Li discloses easy open stackable handle bags. The system comprises a bag pack for use with a bag rack made up of a plurality of aligned individual handle bags. The bags each have an area of adhesive between each bag that allows for the front wall of the successive bag to be pulled from one side as the previous bag is pulled from the bag rack.

U.S. Pat. No. 5,865,313 issued to Huang et al. is directed to a plastic bag pack system with novel handle features. The central pad portions are preferably heat welded together, thus forming a stack of aligned central tab portions. The individual bags of the bag pack are treated on the outside surface by corona surface treatment that prepares the surfaces for receiving printing inks. When adjacent layers of corona surface treated plastic material are cut with a blade, they tend to frangibly bond together. This bonding gives rise to a self-opening feature. Both low density polyethylene and high density polyethylene may be used as the plastic material to form the bags described in this invention.

U.S. Pat. No. 6,079,877 issued to Chew discloses a plastic bag with triangular cut tabs. The outer walls of adjacent bags have been corona-treated and this treatment along with appropriately disposed pressure points enable the bags of the pack to be self-opening.

While other variations exist, the above-described designs for self-opening bag stacks are typical of those encountered in the prior art. It is an objective of the present invention to provide for a polyethylene bag stack that is suitable for use with standardized dispensing racks and includes a self-opening feature. It is a further objective to provide this capability in a bag stack that includes bags that are durable, break-resistant and easily produced. It is a still further objective of the invention to provide the above-described bag packs without the need for localized compressed areas in the bag stack.

While some of the objectives of the present invention are disclosed in the prior art, none of the inventions found include all of the requirements identified.

SUMMARY OF THE INVENTION

The present invention addresses all of the deficiencies of prior art self-opening bag stack inventions and satisfies all of the objectives described above.

(1) A self-opening bag stack providing the desired features may be constructed as follows. A plurality of stacked polyethylene film bags formulated from about 40-48 wt. % high density, high molecular weight polyethylene, 12-20 wt. % high density, medium molecular weight polyethylene, 20-30 wt. % linear low density polyethylene, 0-8 wt. % color concentrate are releasably adhered together in substantial registration. Each of the bags includes front and rear polyethylene film walls. Each of the front and rear walls have first and second side edges, a top edge and a bottom edge. The front and rear walls are integrally joined at their first and second side edges and secured together at their bottom edges. An open mouth portion is defined adjacent the top edges of the bags. At least an upper portion of an outer surface of the front and rear walls of each of the bags has been corona treated.

(2) In a variant of the invention, the self-opening bag stack includes 0.5 wt. % slip and antiblock compound.

(3) In another variant, the self-opening bag stack includes 1-3 wt. % calcium carbonate.

(4) In still another variant, the self-opening bag stack includes 10-20 wt. % recycled material, the recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

(5) In yet another variant, 10-15 wt. % of the linear low density polyethylene has a density ranging from 0.923-0.924 gm/cc.

(6) In a further variant 10-15 wt. % of said linear low density polyethylene has a melt index ranging from 0.25-0.30 gm/10 minutes.

(7) In still a further variant, the high density, medium molecular weight polyethylene has a density ranging from 0.937-0.947 gm/cc.

(8) In yet a further variant, the high density, medium molecular weight polyethylene has a melt index ranging from 0.10-0.30 gm/10 minutes.

(9) In another variant of the invention, at least one cold staking area pierces and extends transversely through the bag stack for maintaining the bags in the bag stack in substantial registration.

(10) In still another variant, at least one hot melt pin area pierces and extends transversely through the bag stack for maintaining the bags in the bag stack in substantial registration.

(11) In a further variant, each of the bags includes longitudinally oriented side gussets.

(12) In a further variant, the self-opening bag stack has first and second openings. The first and second openings penetrate and extend transversely through the bag stack in the upper portion of the bags. The openings are spaced downwardly from the top edge and spaced inwardly from the first and second side edges and serves to support the bag stack on horizontal arms of a dispensing rack.

(13) In still a further variant, each of the bags of the bag stack includes an upper seam. The upper seam seals the front wall to the rear wall at their respective top edges. A U-shaped cut-out is provided. The U-shaped cut-out is located in an upper portion of the bag and begins at a first point along the upper seam. The first point is spaced inwardly from the first side edge and extends to a second point along the upper seam. The second point is spaced inwardly from the second side edge. The cut-out extends downwardly toward the bottom edges, thereby forming an open mouth portion and a pair of bag handles.

(14) In yet a further variant, first and second openings are provided. The first and second openings penetrate and extend transversely through the bag stack in an upper portion of the bag handles. The openings are spaced downwardly from the upper seam and serve to support the bag stack on horizontal arms of a dispensing rack.

(15) In still a further variant of the invention, at least one cold staking area pierces and extends transversely through the bag stack in the bag handles for maintaining the bags in the bag stack in substantial registration.

(16) In another variant, at least one hot melt pin area pierces and extends transversely through the bag stack in the bag handles for maintaining the bags in the bag stack in substantial registration.

(17) In yet another variant, a central tab portion is connected to the open mouth portion of the bags in the bag stack. An aperture is provided. The aperture extends transversely through the bag stack within the central tab portion for suspending the bag stack from a dispensing member.

(18) In still another variant, at least one cold staking area pierces and extends transversely through the bag stack in the central tab portion for maintaining the bags in the bag stack in substantial registration.

(19) In a further variant of the invention, at least one hot melt pin area pierces and extends transversely through the bag stack in the central tab portion for maintaining the bags in the bag stack in substantial registration.

(20) In still a further variant, the central tab portion of each bag in the bag stack is detachably connected to the open mouth portion of the bags.

(21) In yet a further variant, the central tab portion of each bag in the bag stack includes a frangible section. The frangible section extends from the aperture to an outer edge of the central tab portion. The frangible section ruptures upon removal of the bag from the dispensing member.

(22) In another variant, the degree of corona treatment on the outer surfaces of the front and rear walls of each of the bags is an amount sufficient to result in a surface tension on the corona treated surface of at least about 38 dynes/cm.

(23) In still another variant, a self-opening bag stack of t-shirt type bags includes a plurality of stacked polyethylene film bags formulated from about 40-48 wt. % high density, high molecular weight polyethylene, 12-20 wt. % high density, medium molecular weight polyethylene, 20-30 wt. % linear low density polyethylene, 0-8 wt. % color concentrate. The bags are releasably adhered together in substantial registration. Each of the bags includes front and rear polyethylene film walls. Each of the front and rear walls have first and second side edges, a top edge and a bottom edge. The front and rear walls are integrally joined at their first and second side edges and secured together at their bottom edges. An open mouth portion is defined adjacent the top edges. Each of the bags includes laterally spaced upwardly extending bag handles, an open mouth portion between the handles and a central support tab portion extending upwardly from the open mouth portion. At least an upper portion of the outer surface of the front and rear walls of each of the bags having been corona treated.

(24) In yet another variant, the self-opening bag stack includes 0.5 wt. % slip and antiblock compound.

(25) In still another variant, the self-opening bag stack includes 1-3 wt. % calcium carbonate.

(26) In a further variant, the self-opening bag stack includes 10-20 wt. % recycled material, the recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

(27) In yet another variant, 10-15 wt. % of the linear low density polyethylene has a density ranging from 0.923-0.924 gm/cc.

(28) In a further variant, 10-15 wt. % of said linear low density polyethylene has a melt index ranging from 0.25-0.30 gm/10 minutes.

(29) In still a further variant, the high density, medium molecular weight polyethylene has a density ranging from 0.937-0.947 gm/cc.

(30) In yet a further variant, the high density, medium molecular weight polyethylene has a melt index ranging from 0.10-0.30 gm/10 minutes.

(31) In still a further variant, at least one cold staking area pierces and extends transversely through the bag stack for maintaining the bags in the bag stack in substantial registration.

(32) In yet a further variant of the invention, at least one hot melt pin area pierces and extends transversely through the bag stack for maintaining the bags in the bag stack in substantial registration.

(33) In another variant, each of the bags includes longitudinally oriented side gussets.

(34) In still another variant, first and second openings are provided. The first and second openings penetrate and extend transversely through the bag stack in an upper portion of the bag handles. The openings are spaced downwardly from the upper seam and serves to support the bag stack on horizontal arms of the dispensing rack.

(35) In yet another variant, at least one cold staking area pierces and extends transversely through the bag stack in the bag handles for maintaining the bags in the bag stack in substantial registration.

(36) In a further variant, at least one hot melt pin area pierces and extends transversely through the bag stack in the bag handles for maintaining the bags in the bag stack in substantial registration.

(37) In yet a further variant, an aperture is provided. The aperture extends transversely through the bag stack within the central tab portion for suspending the bag stack from a dispensing member.

(38) In still a further variant, at least one cold staking area pierces and extends transversely through the bag stack in the central tab portion for maintaining the bags in the bag stack in substantial registration.

(39) In another variant of the invention, at least one hot melt pin area pierces and extends transversely through the bag stack in the central tab portion for maintaining the bags in the bag stack in substantial registration.

(40) In still another variant, the central tab portion of each bag in the bag stack is detachably connected to the open mouth portion of the bags.

(41) In yet another variant, the central tab portion of each bag in the bag stack includes a frangible section. The frangible section extends from the aperture to an outer edge of the central tab portion. The frangible portion ruptures upon removal of the bag from the dispensing member.

(42) In a final variant of the invention, the degree of corona treatment on the outer surfaces of the front and rear walls of each of the bags is an amount sufficient to result in a surface tension on the corona treated surface of at least about 38 dynes/cm.

An appreciation of the other aims and objectives of the present invention and an understanding of it may be achieved by referring to the accompanying drawings and the detailed description of a preferred embodiment.

DETAILED DESCRIPTION OF THE PREFERRED EMBODIMENT

The present invention addresses all of the deficiencies of prior art self-opening bag stack inventions and satisfies all of the objectives described above.

Figure 1:
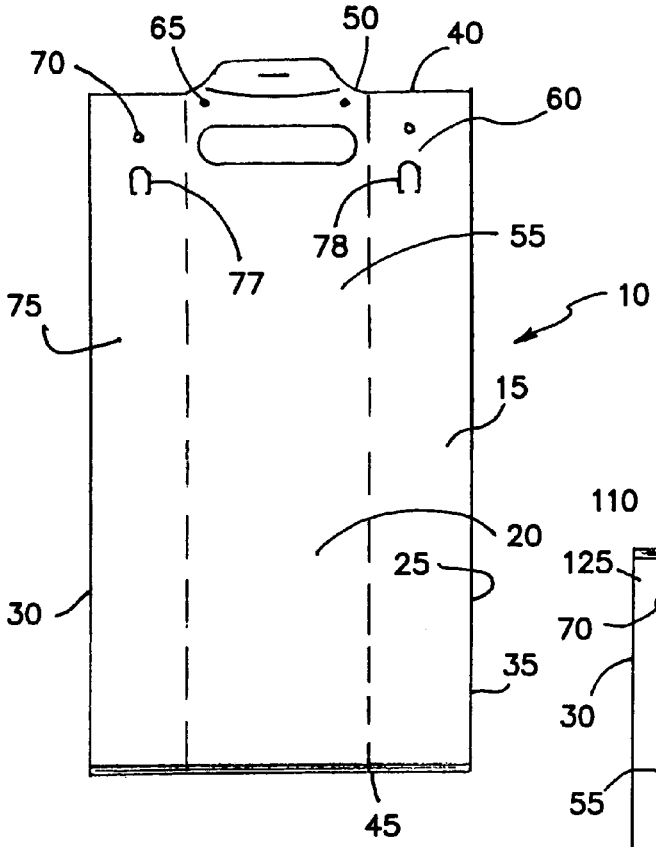
FIG. 1 is a plan view of a gusseted handle bag stack with detachable central tab.

(1) As illustrated in FIG. 1, a self-opening bag stack 10 providing the desired features may be constructed as follows. A plurality of stacked polyethylene film bags 15 formulated from about 40-48 wt. % high density, high molecular weight polyethylene, 12-20 wt. % high density, medium molecular weight polyethylene, 20-30 wt. % linear low density polyethylene, 0-8 wt. % color concentrate are releasably adhered together in substantial registration. Each of the bags 15 includes front 20 and rear 25 polyethylene film walls. Each of the front 20 and rear 25 walls have first 30 and second 35 side edges, a top edge 40 and a bottom edge 45. The front 20 and rear 25 walls are integrally joined at their first 30 and second 35 side edges and secured together at their bottom edges 45. An open mouth portion 50 is defined adjacent the top edges 40 of the bags 15. At least an upper portion 55 of an outer surface 60 of the front 20 and rear 25 walls of each of the bags 15 has been corona treated.

(2) In a variant of the invention, the self-opening bag stack 10 includes 0.5 wt. % slip and antiblock compound.

(3) In another variant, the self-opening bag stack 10 includes 1-3 wt. % calcium carbonate.

(4) In still another variant the self-opening bag stack 10 includes 10-20 wt. % recycled material, the recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

(5) In yet another variant, 10-15 wt. % of the linear low density polyethylene has a density ranging from 0.923-0.924 gm/cc.

(6) In a further variant 10-15 wt. % of said linear low density polyethylene has a melt index ranging from 0.25-0.30 gm/10 minutes.

(7) In still a further variant, the high density, medium molecular weight polyethylene has a density ranging from 0.937-0.947 gm/cc.

(8) In yet a further variant, the high density, medium molecular weight polyethylene has a melt index ranging from 0.10-0.30 gm/10 minutes.

Figure 2:
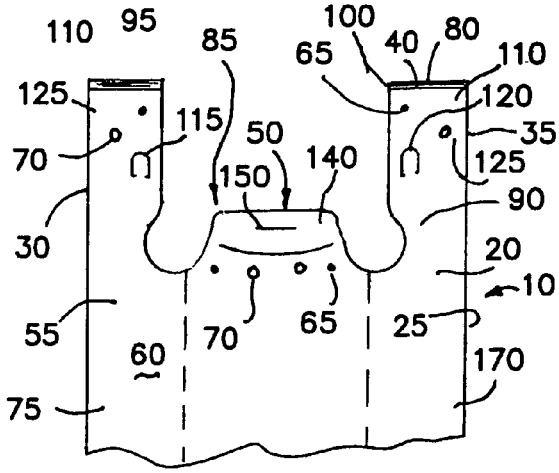
FIG. 2 is a plan view of an upper portion of a T-shirt style bag stack with detachable central tab.

(9) In another variant of the invention, as shown in FIGS. 1 and 2, at least one cold staking area 65 pierces and extends transversely through the bag stack 10 for maintaining the bags 15 in the bag stack 10 in substantial registration.

(10) In still another variant, as shown in FIGS. 1 and 2, at least one hot melt pin area 70 pierces and extends transversely through the bag stack 10 for maintaining the bags 15 in the bag stack 10 in substantial registration.

Figure 3:
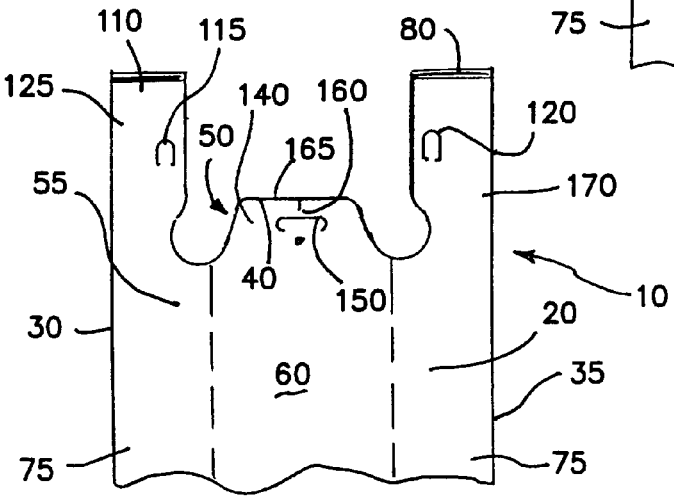
FIG. 3 is a plan view of an upper portion of a T-shirt style bag stack with non-detachable central tab.

(11) In another variant, as shown in FIGS. 1, 2, and 3, each of the bags 15 includes longitudinally oriented side gussets 75.

Figure 4:
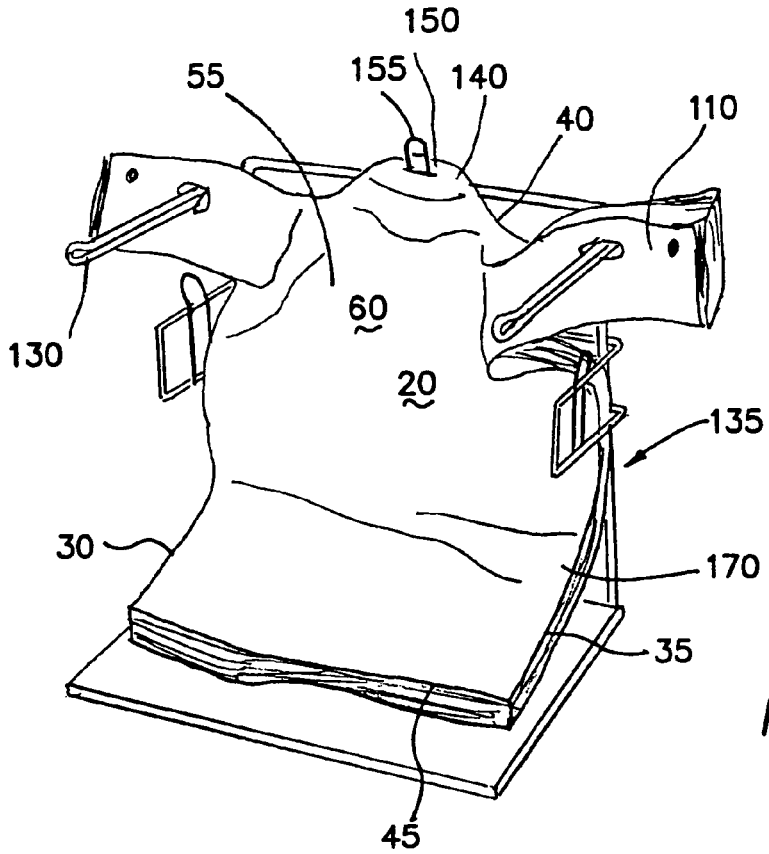
FIG. 4 is a perspective view of the FIG. 2 embodiment disposed upon a dispensing rack.
Figure 5:
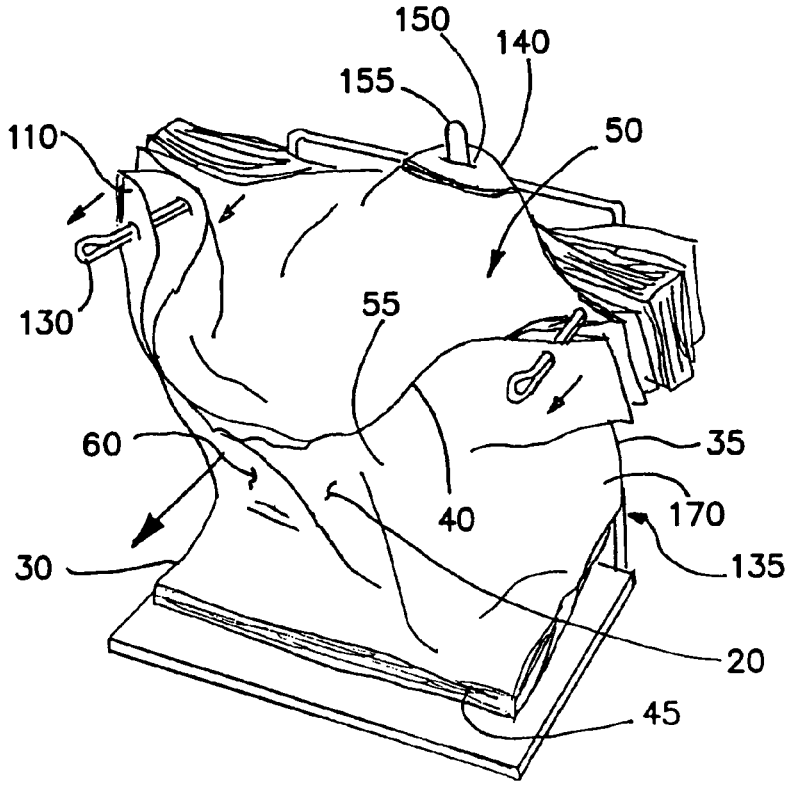
FIG. 5 is a perspective view of the FIG. 3 embodiment disposed upon a dispensing rack.

(12) In a further variant, as shown in FIGS. 1, 4 and 5, the self-opening bag stack 10 has first 77 and second 78 openings. The first 77 and second 78 openings penetrate and extend transversely through the bag stack 10 in the upper portion 55 of the bags 15. The openings 77, 78 are spaced downwardly from the top edge 40 and spaced inwardly from the first 30 and second 35 side edges and serves to support the bag stack 10 on horizontal arms 130 of a dispensing rack 135.

(13) In still a further variant, as illustrated in FIGS. 2, 3, 4 and 5, each of the bags 15 of the bag stack 10 includes an upper seam 80. The upper seam 80 seals the front wall 20 to the rear wall 25 at their respective top edges 40. A U-shaped cut-out 85 is provided. The U-shaped cut-out 85 is located in an upper portion 90 of the bag 15 and begins at a first point 95 along the upper seam 80. The first point 95 is spaced inwardly from the first side edge 30 and extends to a second point 100 along the upper seam 80. The second point 100 is spaced inwardly from the second side edge 35. The cut-out 85 extends downwardly toward the bottom edges 45, thereby forming the an open mouth portion 50 and a pair of bag handles 110.

(14) In yet a further variant, as shown in FIGS. 2, 3, 4, and 5, first 115 and second 120 openings are provided. The first 115 and second 120 openings penetrate and extend transversely through the bag stack 10 in an upper portion 125 of the bag handles 110. The openings 115, 120 are spaced downwardly from the upper seam 80 and serve to support the 20 bag stack 10 on horizontal arms 130 of a dispensing rack 135.

(15) In still a further variant of the invention, as shown in FIG. 2, at least one cold staking area 65 pierces and extends transversely through the bag stack 10 in the bag handles 110 for maintaining the bags 15 in the bag stack 10 in substantial registration.

(16) In another variant, as shown in FIG. 2, at least one hot melt pin area 70 pierces and extends transversely through the bag stack 10 in the bag handles 110 for maintaining the bags 15 in the bag stack 10 in substantial registration.

(17) In yet another variant, as shown in FIGS. 2, 3, 4, and 5, a central tab portion 140 is connected to the open mouth portion 50 of the bags 15 in the bag stack 10. An aperture is provided 150. The aperture 150 extends transversely through the bag stack 10 within the central tab portion 140 for suspending the bag stack 10 from a dispensing member 155.

(18) In still another variant, as shown in FIG. 2, at least one cold staking area 65 pierces and extends transversely through the bag stack 10 in the central tab portion 140 for maintaining the bags 15 in the bag stack 10 in substantial registration.

(19) In a further variant of the invention, as shown in FIG. 2, at least one hot melt pin area 70 pierces and extends transversely through the bag stack 10 in the central tab portion 140 for maintaining the bags in the bag stack 10 in substantial registration.

(20) In still a further variant, as illustrated in FIG. 2, the central tab portion 140 of each bag 15 in the bag stack 10 is detachably connected to the open mouth portion 50 of the bags 15.

(21) In yet a further variant, as illustrated in FIG. 3, the central tab portion 140 of each bag 15 in the bag stack 10 includes a frangible section 160. The frangible section 160 extends from the aperture 150 to an outer edge 165 of the central tab portion 140. The frangible section 160 ruptures upon removal of the bag 15 from the dispensing member 155.

(22) In another variant, the degree of corona treatment on the outer surfaces 60 of the front 20 and rear 25 walls of each of the bags 15 is an amount sufficient to result in a surface tension on the corona treated surface 60 of at least about 38 dynes/cm.

(23) In still another variant, a self-opening bag stack 10 of t-shirt type bags 170 includes a plurality of stacked polyethylene film bags 170 formulated from about 40-48 wt. % high density, high molecular weight polyethylene, 12-20 wt. % high density, medium molecular weight polyethylene, 20-30 wt. % linear low density polyethylene, 0-8 wt. % color concentrate. The bags 170 are releasably adhered together in substantial registration. Each of the bags 170 includes front 20 and rear 25 polyethylene film walls. Each of the front 20 and rear 25 walls have first 30 and second 35 side edges, a top edge 40 and a bottom edge 45. The front 20 and rear 25 walls are integrally joined at their first 30 and second 35 side edges and secured together at their bottom edges 45. An open mouth portion 50 is defined adjacent the top edges 40. Each of the bags 170 includes laterally spaced upwardly extending bag handles 110, an open mouth portion 50 between the handles 110 and a central support tab portion 140 extending upwardly from the open mouth portion 50. At least an upper portion 55 of the outer surface 60 of the front 20 and rear 25 walls of each of the bags 170 having been corona treated.

(24) In yet another variant, the self-opening bag stack 10 includes 0.5 wt. % slip and antiblock compound.

(25) In still another variant, the self-opening bag stack 10 includes 1-3 wt. % calcium carbonate.

(26) In a further variant, the self-opening bag stack 10 includes 10-20 wt. % recycled material, the recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

(27) In yet another variant, 10-15 wt. % of the linear low density polyethylene has a density ranging from 0.923-0.924 gm/cc.

(28) In a further variant 10-15 wt. % of said linear low density polyethylene has a melt index ranging from 0.25-0.30 gm/10 minutes.

(29) In still a further variant, the high density, medium molecular weight polyethylene has a density ranging from 0.937-0.947 gm/cc.

(30) In yet a further variant, the high density, medium molecular weight polyethylene has a melt index ranging from 0.10-0.30 gm/10 minutes.

(31) In still a further variant, as shown in FIG. 2, at least one cold staking area 65 pierces and extends transversely through the bag stack 10 for maintaining the bags 15 in the bag stack 10 in substantial registration.

(32) In yet a further variant of the invention, as shown in FIG. 2, at least one hot melt pin area 70 pierces and extends transversely through the bag stack 10 for maintaining the bags 170 in the bag stack 10 in substantial registration.

(33) In another variant, as shown in FIGS. 1, 2 and 3, each of the bags 170 includes longitudinally oriented side gussets 75.

(34) In still another variant, as shown in FIGS. 2 and 3, first 115 and second 120 openings are provided. The first 115 and second 120 openings penetrate and extend transversely through the bag stack 10 in an upper portion 125 of the bag handles 110. The openings 115,120 are spaced downwardly from the upper seam 80 and serving to support the bag stack 10 on horizontal arms 130 of the dispensing rack 135.

(35) In yet another variant, as shown in FIGS. 2 and 3, at least one cold staking area 65 pierces and extends transversely through the bag stack 10 in the bag handles 110 for maintaining the bags 170 in the bag stack 10 in substantial registration.

(36) In a further variant, as shown in FIGS. 2 and 3 at least one hot melt pin area 70 pierces and extends transversely through the bag stack 10 in the bag handles 110 for maintaining the bags 170 in the bag stack 10 in substantial registration.

(37) In yet a further variant, as shown in FIGS. 3, 4, and 5, an aperture 150 is provided. The aperture 150 extends transversely through the bag stack 10 within the central tab portion 140 for suspending the bag stack 10 from a dispensing member 155.

(38) In still a further variant, as shown in FIG. 2, at least one cold staking area 65 pierces and extends transversely through the bag stack 10 in the central tab portion 140 for maintaining the bags 170 in the bag stack 10 in substantial registration.

(39) In another variant of the invention, as shown in FIG. 2, at least one hot melt pin area 70 pierces and extends transversely through the bag stack 10 in the central tab portion 140 for maintaining the bags 170 in the bag stack 10 in substantial registration.

(40) In still another variant, as shown in FIG. 2, the central tab portion 140 of each bag 170 in the bag stack 10 is detachably connected to the open mouth portion 50 of the bags 15.

(41) In yet another variant, as shown in FIG. 3, the central tab portion 140 of each bag 170 in the bag stack 10 includes a frangible section 160. The frangible section 160 extends from the aperture 150 to an outer edge 165 of the central tab portion 140. The frangible portion 160 ruptures upon removal of the bag 170 from the dispensing member 155.

(42) In a final variant of the invention, the degree of corona treatment on the outer surfaces 60 of the front 20 and rear 25 walls of each of the bags 170 is an amount sufficient to result in a surface tension on the corona treated surface 60 of at least about 38 dynes/cm.

An appreciation of the other aims and objectives of the present invention and an understanding of it may be achieved by referring to the accompanying drawings and the detailed description of a preferred embodiment.

The invention claimed is:

1. A self-opening bag stack comprising:

a plurality of stacked polyethylene film bags comprising about 40-48 wt. % high density, high molecular weight polyethylene, 12-20 wt. % high density, medium molecular weight polyethylene, 20-30 wt. % linear low density polyethylene having a melt index ranging from 0.10-0.30 gm/10 minutes., 0-8 wt. % color concentrate, releasably adhered together in substantial registration;

each of said bags including front and rear polyethylene film walls, each of said front and rear walls having first and second side edges, a top edge and a bottom edge;

said front and rear walls being integrally joined at their first and second side edges and secured together at their bottom edges and defining an open mouth portion adjacent said top edges; and at least an upper portion of an outer surface of said front and rear walls of each of said bags having been corona treated.

2. The self-opening bag stack, as described in claim 1, further comprising 0.5 wt. % slip and antiblock compound.

3. The self-opening bag stack, as described in claim 1, further comprising 1-3 wt. % calcium carbonate.

4. The self-opening bag stack, as described in claim 1, further comprising 10-20 wt. % recycled material, said recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

5. The self-opening bag stack, as described in claim 1, wherein 10-15 wt. % of said linear low density polyethylene has a density ranging from 0.923-0.924 gm/cc.

6. The self-opening bag stack, as described in claim 1, wherein 10-15 wt. % of said linear low density polyethylene has a melt index ranging from 0.25-0.30 gm/10 minutes.

7. The self-opening bag stack, as described in claim 1, wherein said high density, medium molecular weight polyethylene has a density ranging from 0.937-0.947 gm/cc.

8. The self-opening bag stack, as described in claim 1, further comprising at least one cold staking area piercing and extending transversely through said bag stack for maintaining the bags in said bag stack in substantial registration.

9. The self-opening bag stack, as described in claim 1, further comprising at least one hot melt pin area piercing and extending transversely through said bag stack for maintaining the bags in said bag stack in substantial registration.

10. The self-opening bag stack, as described in claim 1, wherein each of said bags includes longitudinally oriented side gussets.

11. The self-opening bag stack, as described in claim 1, further comprising:

first and second openings, said first and second openings penetrating and extending transversely through said bag stack in an upper portion of the bags; and said openings being spaced downwardly from said top edge, spaced inwardly from said first and second side edges and serving to support said bag stack on horizontal arms of a dispensing rack.

12. The self-opening bag stack, as described in claim 10, wherein each of the bags of the bag stack further comprises:

an upper seam, said upper seam sealing said front wall to said rear wall at their respective top edges; and a U-shaped cut-out, said U-shaped cut-out being disposed in an upper portion of said bag and commencing at a first point along said upper seam spaced inwardly from said first side edge and extending to a second point along the upper seam spaced inwardly from said second side edge, said cut-out extending downwardly toward said bottom edges, thereby forming an open mouth portion and a pair of bag handles.

13. The self-opening bag stack, as described in claim 12, further comprising:

first and second openings, said first and second openings penetrating and extending transversely through said bag stack in an upper portion of said bag handles; and said openings being spaced downwardly from said upper seam and serving to support said bag stack on horizontal arms of a dispensing rack.

14. The self-opening bag stack, as described in claim 12, further comprising at least one cold staking area piercing and extending transversely through said bag stack in said bag handles for maintaining the bags in said bag stack in substantial registration.

15. The self-opening bag stack, as described in claim 12, further comprising at least one hot melt pin area piercing and extending transversely through said bag stack in said bag handles for maintaining the bags in said bag stack in substantial registration.

16. The self-opening bag stack, as described in claim 1 or claim 12, further comprising:

a central tab portion connected to said open mouth portion of said bags in said bag stack; and an aperture, said aperture extending transversely through said bag stack within said central tab portion for suspending said bag stack from a dispensing member.

17. The self-opening bag stack, as described in claim 16, further comprising at least one cold staking area piercing and extending transversely through said bag stack in said central tab portion for maintaining the bags in said bag stack in substantial registration.

18. The self-opening bag stack, as described in claim 16, further comprising at least one hot melt pin area piercing and extending transversely through said bag stack in said central tab portion for maintaining the bags in said bag stack in substantial registration.

19. The self-opening bag stack, as described in claim 16, wherein said central tab portion of each bag in said bag stack is detachably connected to said open mouth portion of said bags.

20. The self-opening bag stack, as described in claim 16, wherein:

said central tab portion of each bag in said bag stack includes a frangible section;

said frangible section extending from said aperture to an outer edge of said central tab portion; and said frangible portion rupturing upon removal of said bag from said dispensing member.

21. The self-opening bag stack, as described in claim 1 wherein the degree of corona treatment on said outer surfaces of said front and rear walls of each of said bags is an amount sufficient to result in a surface tension on said corona treated surface of at least about 38 dynes/cm.

22. A self-opening bag stack of t-shirt type bags comprising:

a plurality of stacked polyethylene film bags comprising about 40-48 wt. % high density, high molecular weight polyethylene, 12-20 wt. % high density, medium molecular weight polyethylene having a melt index ranging from 0.10-0.30 gm/10 minutes, 20-30 wt. % linear low density polyethylene, 0-8 wt. % color concentrate, releasably adhered together in substantial registration;

each of said bags including front and rear polyethylene film walls, each of said front and rear walls having first and second side edges, a top edge and a bottom edge;

said front and rear walls being integrally joined at their first and second side edges and secured together at their bottom edges and defining an open mouth portion adjacent said top edges;

each of said bags comprising laterally spaced upwardly extending bag handles, an open mouth portion between said handles and a central support tab portion extending upwardly from said open mouth portion; and at least an upper portion of the outer surface of the front and rear walls of each of said bags having been corona treated.

23. The self-opening bag stack, as described in claim 22, further comprising 0.5 wt. % slip and antiblock compound.

24. The self-opening bag stack, as described in claim 22, further comprising 1-3 wt. % calcium carbonate.

25. The self-opening bag stack, as described in claim 22, further comprising 10-20 wt. % recycled material, said recycled material comprising about 40-48 wt. % high density, high molecular weight polyethylene, 12-20 wt. % high density, medium molecular weight polyethylene, 20-30 wt. % linear low density polyethylene, 0-8 wt. % color concentrate.

26. The self-opening bag stack, as described in claim 22, wherein 10-15 wt. % of said linear low density polyethylene has a density ranging from 0.923-0.924 gm/cc.

27. The self-opening bag stack, as described in claim 22, wherein 10-15 wt. % of said linear low density polyethylene has a melt index ranging from 0.25-0.30 gm/10 minutes.

28. The self-opening bag stack, as described in claim 22, wherein said high density, medium molecular weight polyethylene has a density ranging from 0.937-0.947 gm/cc.

29. The self-opening bag stack, as described in claim 22, further comprising at least one cold staking area piercing and extending transversely through said bag stack for maintaining the bags in said bag stack in substantial registration.

30. The self-opening bag stack, as described in claim 22, further comprising at least one hot melt pin area piercing and extending transversely through said bag stack for maintaining the bags in said bag stack in substantial registration.

31. The self-opening bag stack, as described in claim 22, wherein each of said bags includes longitudinally oriented side gussets.

32. The self-opening bag stack, as described in claim 22, further comprising:

first and second openings, said first and second openings penetrating and extending transversely through said bag stack said bag stack in an upper portion of said bag handles; and said openings being spaced downwardly from said upper seam and serving to support said bag stack on horizontal arms of a dispensing rack.

33. The self-opening bag stack, as described in claim 22, further comprising at least one cold staking area piercing and extending transversely through said bag stack in said bag handles for maintaining the bags in said bag stack in substantial registration.

34. The self-opening bag stack, as described in claim 22, further comprising at least one hot melt pin area piercing and extending transversely through said bag stack in said bag handles for maintaining the bags in said bag stack in substantial registration.

35. The self-opening bag stack, as described in claim 22, further comprising an aperture, said aperture extending transversely through said bag stack within said central tab portion for suspending said bag stack from a dispensing member.

36. The self-opening bag stack, as described in claim 22, further comprising at least one cold staking area piercing and extending transversely through said bag stack in said central tab portion for maintaining the bags in said bag stack in substantial registration.

37. The self-opening bag stack, as described in claim 22, further comprising at least one hot melt pin area piercing and extending transversely through said bag stack in said central tab portion for maintaining the bags in said bag stack in substantial registration.

38. The self-opening bag stack, as described in claim 22, wherein said central tab portion of each bag in said bag stack is detachably connected to said open mouth portion of said bags.

39. The self-opening bag stack, as described in claim 22, wherein:

said central tab portion of each bag in said bag stack includes a frangible section;

said frangible section extending from said aperture to an outer edge of said central tab portion; and said frangible portion rupturing upon removal of said bag from said dispensing member.

40. The self-opening bag stack, as described in claim 22 wherein the degree of corona treatment on said outer surfaces of said front and rear walls of each of said bags is an amount sufficient to result in a surface tension on said corona treated surface of at least about 38 dynes/cm.

* * * * *